US008182208B2

(12) United States Patent
Bridges, Jr. et al.

(10) Patent No.: US 8,182,208 B2
(45) Date of Patent: May 22, 2012

(54) GAS TURBINE SYSTEMS INVOLVING FEATHER SEALS

(75) Inventors: Joseph W. Bridges, Jr., Durham, CT (US); Tracy A Propheter-Hinckley, Manchester, CT (US)

(73) Assignee: United Technologies Corp., Hartford, CT (US)

( * ) Notice: Subject to any disclaimer, the term of this patent is extended or adjusted under 35 U.S.C. 154(b) by 1175 days.

(21) Appl. No.: 11/775,330

(22) Filed: Jul. 10, 2007

(65) Prior Publication Data

US 2009/0016873 A1 Jan. 15, 2009

(51) Int. Cl.
*F01D 9/04* (2006.01)

(52) U.S. Cl. ..... 415/139; 277/630; 277/641; 277/637; 277/644

(58) Field of Classification Search ..... 415/134, 415/139, 173.1, 173.7; 277/630, 638, 641, 277/648, 649
See application file for complete search history.

(56) References Cited

U.S. PATENT DOCUMENTS

| | | | | |
|---|---|---|---|---|
| 4,477,086 | A | 10/1984 | Feder et al. | |
| 4,524,980 | A | 6/1985 | Lillibridge et al. | |
| 4,749,333 | A | 6/1988 | Bonner et al. | |
| 5,141,395 | A | 8/1992 | Carroll et al. | |
| 5,531,457 | A | 7/1996 | Tibbott et al. | |
| 5,709,530 | A | 1/1998 | Cahill et al. | |
| 5,755,556 | A | 5/1998 | Hultgren et al. | |
| 5,868,398 | A | 2/1999 | Maier et al. | |
| 6,109,843 | A | 8/2000 | Descoteaux | |
| 6,171,058 | B1 * | 1/2001 | Stec | 416/193 A |
| 6,267,553 | B1 | 7/2001 | Burge | |
| 6,315,298 | B1 | 11/2001 | Kildea et al. | |
| 6,796,769 | B2 | 9/2004 | Moroso | |
| 7,186,079 | B2 | 3/2007 | Suciu et al. | |
| 7,625,174 | B2 * | 12/2009 | Drerup et al. | 415/135 |
| 2006/0182624 | A1 * | 8/2006 | London et al. | 415/170.1 |
| 2007/0140843 | A1 | 6/2007 | Drerup et al. | |
| 2009/0096174 | A1 * | 4/2009 | Spangler et al. | 277/345 |
| 2009/0269188 | A1 * | 10/2009 | Martin | 415/173.1 |

OTHER PUBLICATIONS

EP Search report dated Nov. 23, 2011.

* cited by examiner

*Primary Examiner* — Edward Look
*Assistant Examiner* — Ryan Ellis

(57) ABSTRACT

Systems involving feather seals are provided. A representative vane assembly for a gas turbine engine includes: a first mounting platform having a first slot; a first airfoil extending from the first mounting platform; and a feather seal having opposing faces, a first side extending between the faces, and a first tab, the first tab extending outwardly beyond the first side; the first slot being sized and shaped to receive the feather seal including the first tab.

10 Claims, 3 Drawing Sheets

GAS TURBINE SYSTEMS INVOLVING FEATHER SEALS

STATEMENT REGARDING FEDERALLY SPONSORED RESEARCH AND DEVELOPEMENT

The U.S. Government may have an interest in the subject matter of this disclosure as provided for by the terms of contract number N00019-02-C-303 awarded by the United States Air Force.

BACKGROUND

1. Technical Field

The disclosure generally relates to seals used in gas turbine engines.

2. Description of the Related Art

Various gas turbine engine components are subjected to heating and cooling cycles that cause the components to expand and contract. Expansion and contraction causes challenges in forming seals between components to prevent gas leakage.

Turbine vane assemblies are examples of components that typically experience expansion and contraction during use. In order to prevent gas leakage between adjacent vanes of a vane assembly, feather seals have been used. A feather seal, which is typically configured as a strip of metal, is positioned between opposing slots of adjacent vanes. Notably, when the vanes are cold, the feather seal typically floats loosely within the opposing slots. However, after the vanes expand due to heating, the feather seal tends to fit more tightly within the opposing slots.

Designing a feather seal can be quite challenging. In particular, the width of a feather seal may be established so that the seal will not fall out of the slots when the vanes cool and contract. However, the width should be narrow enough so that the vanes do not crush the feather seal when the vanes heat and expand.

SUMMARY

Systems involving feather seals are provided. In this regard, an exemplary embodiment of a vane assembly for a gas turbine engine comprises: a first mounting platform having a first slot; a first airfoil extending from the first mounting platform; and a feather seal having opposing faces, a first side extending between the faces, and a first tab, the first tab extending outwardly beyond the first side; the first slot being sized and shaped to receive the feather seal including the first tab.

An exemplary embodiment of a feather seal for a gas turbine engine comprises: opposing faces; a first side extending between the faces; and a first tab extending outwardly beyond the first side, the first tab being located in a plane defined by the opposing faces.

An exemplary embodiment of a gas turbine engine comprises: a compressor; a combustion section; and a turbine operative to drive the compressor responsive to energy imparted thereto by the combustion section, the turbine having a vane assembly, the vane assembly having a first vane comprising: a first mounting platform having a first slot; a first airfoil extending from the first mounting platform; and a feather seal having opposing faces, a first side and a first tab, the first side extending between the faces, the first tab extending outwardly beyond the first side; the first slot being sized and shaped to receive the feather seal including the first tab.

Other systems, methods, features and/or advantages of this disclosure will be or may become apparent to one with skill in the art upon examination of the following drawings and detailed description. It is intended that all such additional systems, methods, features and/or advantages be included within this description and be within the scope of the present disclosure.

BRIEF DESCRIPTION OF THE DRAWINGS

Many aspects of the disclosure can be better understood with reference to the following drawings. The components in the drawings are not necessarily to scale. Moreover, in the drawings, like reference numerals designate corresponding parts throughout the several views.

DETAILED DESCRIPTION

Several exemplary embodiments of systems involving feather seals will now be described in greater detail. In this regard, at least some of these embodiments involve a feather seal that incorporates at least a first tab that effectively widens the feather seal at the location of the tab. The tab is configured to be received by a corresponding feature of a vane. By way of example, the feature can be a cavity or through-hole into which the tab is inserted. So configured, the feather seal can be designed narrow enough to limit component weight, while the tab effectively widens the feather seal. That is, the tab locally widens the feather seal so that the feather seal does not tend to fall out of place when the vane contracts during cooling. Thus, one or more tabs of a feather seal can be sized for preventing fall-out and remaining portions of the feather seal can be sized to accommodate crushing considerations.

Figure 1:
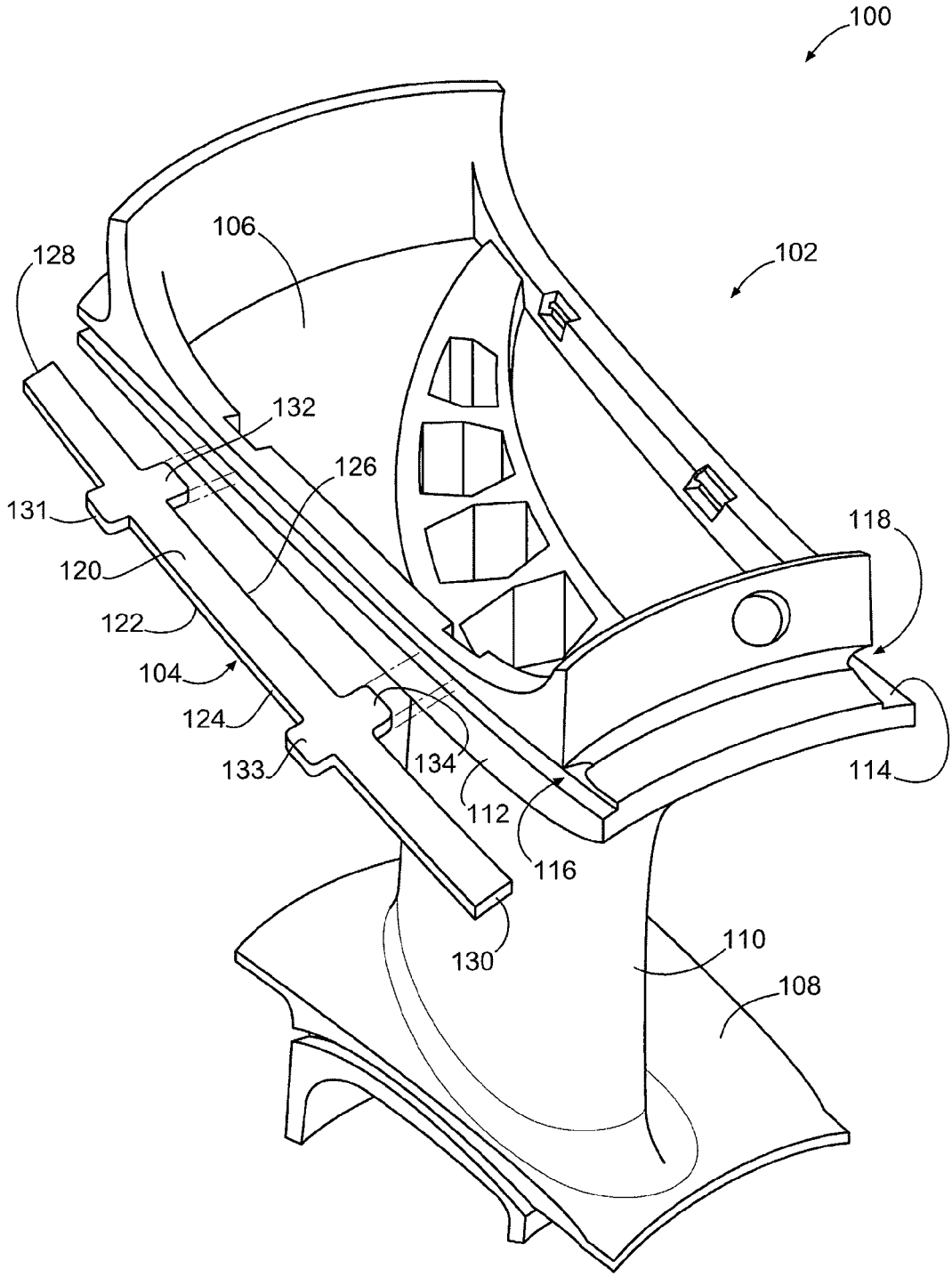
FIG. 1 is a schematic diagram of an embodiment of a system involving a feather seal.

In this regard, an embodiment of a system involving feather seals is depicted schematically in FIG. 1. In this embodiment, system 100 incorporates a vane 102 and a feather seal 104. Specifically, vane 102 incorporates an outer mounting platform 106, an inner mounting platform 108, and an airfoil 110 extending between the outer mounting platform and the inner mounting platform. Notably, the outer mounting platform includes rails 112 and 114, which define slots 116 and 118, respectively. The slots are sized and shaped to receive a portion of the feather seal.

Feather seal 104 is generally elongate, exhibiting a longitudinal axis, and is planar. In this embodiment, the feather seal is formed of a strip of material, e.g. a Cobalt alloy, such as Haynes-188. The feather seal has opposing faces 120, 122, sidewalls 124, 126 extending between the faces, and endwalls 128, 130 extending between the faces and between the sidewalls. In cross-section, the feather seal of this embodiment is generally rectangular.

Tabs 131, 132, 133 and 134 extend outwardly beyond the sidewalls of the feather seal. In particular, tabs 131 and 133 extend beyond sidewall 124, and tabs 132 and 134 extend beyond sidewall 126. In this embodiment, the tabs are generally rectangular and are positioned in opposing pairs along a length of the feather seal. In other embodiments, various other numbers, shapes and/or arrangements of tabs can be used. For instance, in some embodiments, one or more portions of the tabs could be tapered, such as by incorporating a chamfer.

Figure 2:
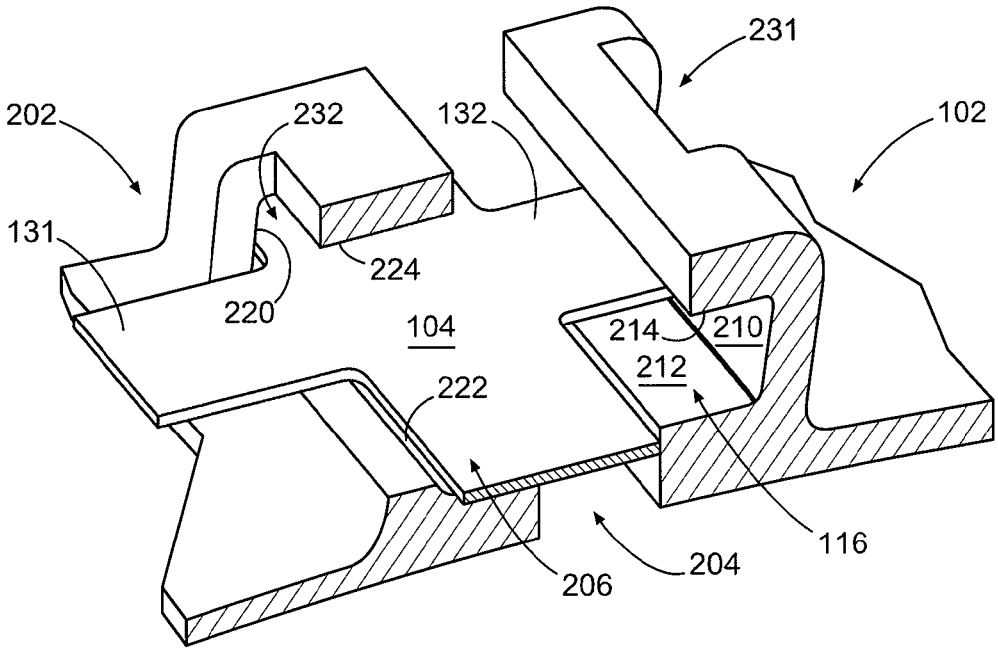
FIG. 2 is a schematic, cut-away of the embodiment of FIG. 1, showing the vane and an adjacent vane engaging the feather seal when the engine is cold or being assembled.

FIG. 2 schematically depicts the embodiment of FIG. 1 positioned next to an adjacent vane 202, with the feather seal 104 installed to seal a gap formed between vane 102 and vane 202. Specifically, when in the installed position shown in FIG. 2, a gap 204 is formed between the vanes when the vanes are cold.

In the installed position, the feather seal is held within slot 116 of vane 102 and slot 206 of vane 202. Specifically, slot 116 is defined by a backwall 210, and walls 212 and 214 that are spaced from each other and that extend from backwall 210. Similarly, slot 206 is defined by a backwall 220, and walls 222 and 224 that are spaced from each other and that extend from 220 backwall.

Each of the slots communicates with a corresponding through-hole that is configured to receive a tab. In this case, slot 116 communicates with through-hole 231 and slot 206 communicates with through-hole 232. In this embodiment, the through-holes are formed by the material of the walls that define the rails. Additionally, each incorporates a recess.

In the configuration depicted in FIG. 2, the feather seal is not wide enough at non-tabbed locations to extend from the backwall of one rail to the backwall of the other. However, the tabs tend to prevent the feather seal from falling out of the slots by spanning the gap 204 between the adjacent vanes.

Figure 3:
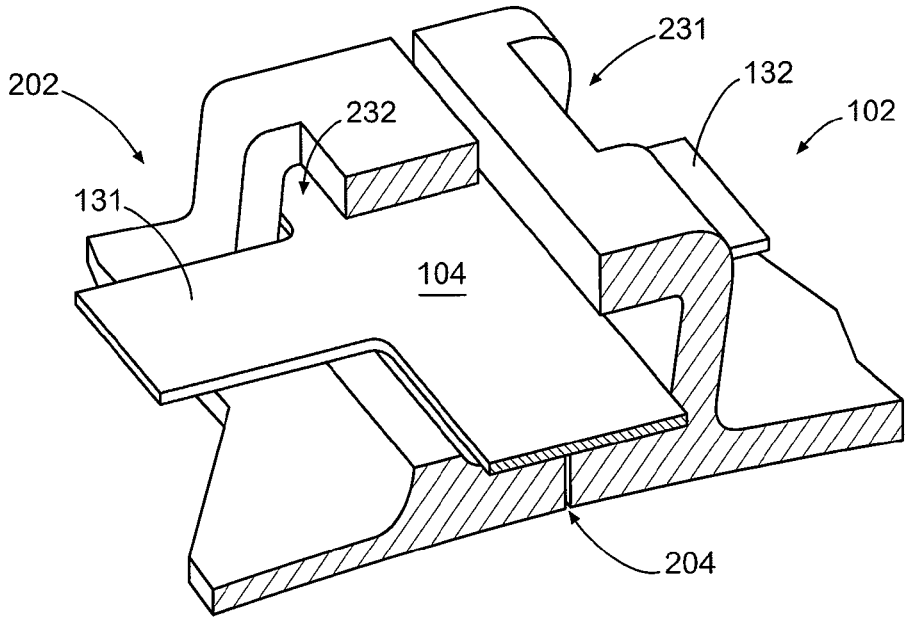
FIG. 3 is a schematic, cut-away of the embodiment of FIG. 1, showing the vane and an adjacent vane engaging the feather seal when the engine is hot.

FIG. 3 depicts the embodiment of FIG. 2 after heating; thus, the vanes have expanded. Note that, in this configuration, the gap 204 between the adjacent vanes has significantly reduced in size such that the non-tabbed locations of the feather seal are in close proximity to the backwalls of the rails. Note also that the through-holes have accommodated repositioning of the tabs by enabling more material of the tabs to be inserted through the through-holes. Thus, despite the gap between the vanes being narrowed due to heating, the feather seal is not crushed.

Figure 4:
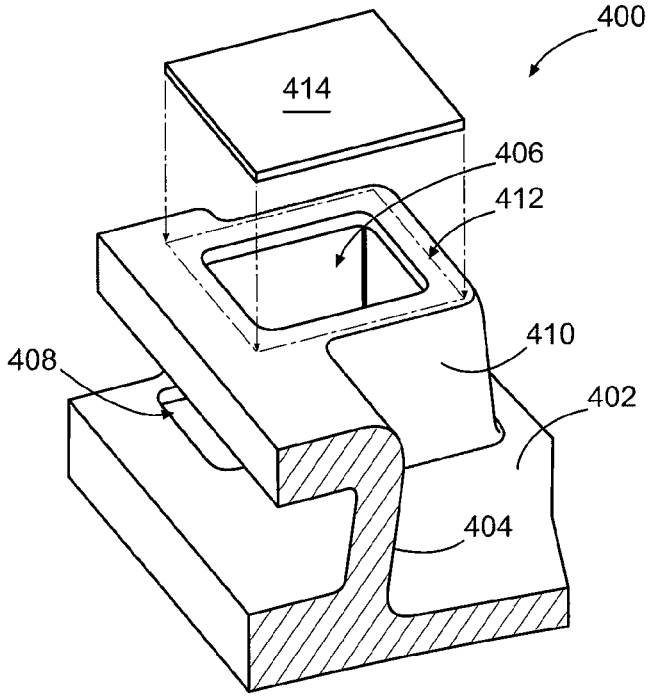
FIG. 4 is a schematic, cut-away of another embodiment of a system involving a feather seal.

Another embodiment of a vane is depicted schematically in FIG. 4. As shown in FIG. 4, vane 400 includes an outer mounting platform 402, a portion of which is depicted. In particular, outer mounting platform 402 includes a rail 404 and a feature for receiving a tab of a feather seal. In this embodiment, the feature is a cavity 406 that incorporates an entrance 408.

In this configuration, a tab of a feather seal (not shown) can be inserted into the cavity via the entrance. In such an embodiment, any gas leakage that may occur in a vicinity of the tab can be contained by the sealed cavity. Note that in this embodiment, construction of the sealed cavity is facilitated by casting a lower portion 410 of material that defines the cavity integrally with the outer mounting platform; however, other techniques can be used in other embodiments. This casting results in an opening 412 for facilitating release and holding of the component during manufacture. Sealing of the cavity is accomplished by attaching a wall 414, in this case a plate, to the cast portion. In some embodiments, such as here, this can accomplished by welding the plate to the outer mounting platform.

Figure 5:
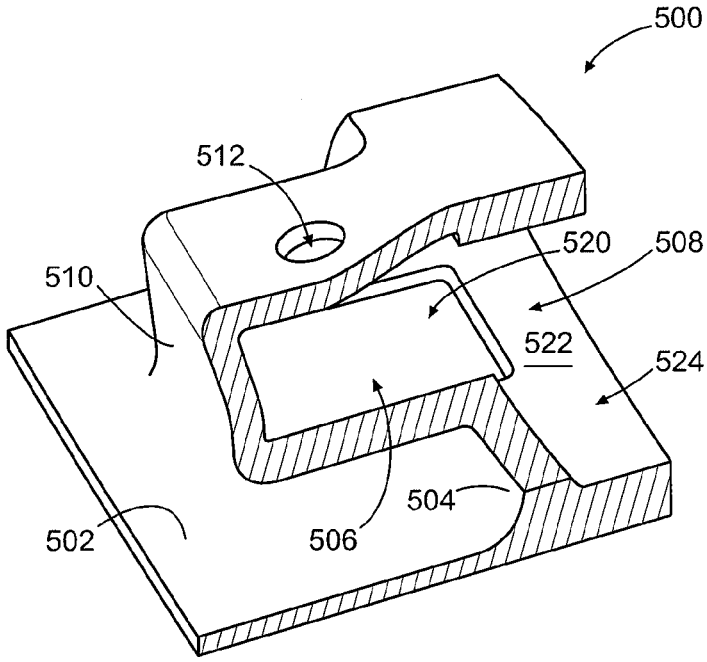
FIG. 5 is a schematic, cut-away of another embodiment of a system involving a feather seal.

Another embodiment of a vane is depicted schematically in FIG. 5. This embodiment differs from that depicted in FIG. 4 by incorporating a casting feature that can be sealed without the use of a wall. In particular, vane 500 includes an outer mounting platform 502, a portion of which is depicted. In particular, outer mounting platform 502 includes a rail 504 and a cavity 506 that incorporates an entrance 508.

In this embodiment, the sealed cavity is constructed by casting a lower portion 510 of the cavity integrally with the outer mounting platform. This casting results in an opening 512 for facilitating release of the component during manufacture. In contrast to the embodiment of FIG. 4, opening 512 can be sealed by welding the opening closed without using a wall. In other embodiments, such an opening may not be incorporated into the final component as other manufacturing methods could be used.

FIG. 5 also depicts recess 520 that extends from the cavity and into a wall 522 that partially defines slot 524. In this embodiment, recess 520 is generally rectangular and extends along the floor of the cavity 506. In some embodiments, a recess may be avoided. However, such a recess can be used to ensure that a ridge or other raised surface is not present along the intersection of the cavity and the slot as may be caused by different manufacturing techniques for forming the cavity and slot.

It should be emphasized that the above-described embodiments are merely possible examples of implementations set forth for a clear understanding of the principles of this disclosure. Many variations and modifications may be made to the above-described embodiments without departing substantially from the spirit and principles of the disclosure. All such modifications and variations are intended to be included herein within the scope of this disclosure and protected by the accompanying claims.

The invention claimed is:

1. A vane assembly for a gas turbine engine comprising:

a first mounting platform having a first slot and a first through-hole;

a first airfoil extending from the first mounting platform; and a feather seal having opposing faces, a first side extending between the faces, and a first tab, the first tab extending outwardly beyond the first side;

the first slot being sized and shaped to receive the feather seal including the first tab; and the first through-hole communicating with the first slot such that, when the first side of the feather seal is inserted into the first slot, the first tab is received within the first through-hole.

2. The vane assembly of claim 1, wherein:

the feather seal has a second side extending between the faces and a second tab extending outwardly beyond the second side;

the vane assembly further comprises:

a second mounting platform having a second slot; and a second airfoil extending from the second mounting platform;

the second slot is sized and shaped to receive the feather seal including the second tab.

3. The vane assembly of claim 2, wherein:

the second mounting platform has a second through-hole communicating with the second slot;

the second slot is sized and shaped to receive the feather seal such that, when the second side is inserted into the second slot, the second tab is received within the second through-hole.

4. The feather seal of claim 1, wherein, as viewed in cross-section along a length thereof, the feather seal is rectangular.

5. The feather seal of claim 1, wherein the first tab and the second tab are located along a length of the feather seal such that the feather seal is symmetric along a longitudinal axis.

6. A gas turbine engine comprising:

a compressor;

a combustion section; and a turbine operative to drive the compressor responsive to energy imparted thereto by the combustion section, the turbine having a vane assembly, the vane assembly having a first vane comprising:

a first mounting platform having a first slot and a first through-hole;

a first airfoil extending from the first mounting platform; and a feather seal having opposing faces, a first side and a first tab, the first side extending between the faces, the first tab extending outwardly beyond the first side;

the first slot being sized and shaped to receive the feather seal including the first tab; and the first through-hole communicating with the first slot such that, when the first side of the feather seal is inserted into the first slot, the first tab is received within the first through-hole.

7. The gas turbine of claim 6, wherein the first tab is located in a plane defined by the opposing faces.

8. The gas turbine of claim 6, wherein:

the feather seal has a second side extending between the faces and a second tab extending outwardly beyond the second side;

the vane assembly has a second vane comprising:

a second mounting platform having a second slot; and a second airfoil extending from the second mounting platform;

the second slot is sized and shaped to receive the feather seal including the second tab.

9. The gas turbine of claim 8, wherein the first tab and the second tab are located along a length of the feather seal such that the feather seal is symmetric along a longitudinal axis.

10. The gas turbine of claim 6, wherein:

the feather seal has a second side extending between the faces and a second tab extending outwardly beyond the second side;

the vane assembly has a second vane comprising:

a second mounting platform having a second slot a second through-hole communicating with the second slot; and a second airfoil extending from the second mounting platform;

the second slot is sized and shaped to receive the feather seal including the second tab;

when the first vane and the second vane cool and contract, the first tab extends into the first slot and the second tab extends into the second slot such that the feather seal is maintained in position between the first vane and the second vane; and when the first vane and the second vane heat and expand, the first tab extends into the first through-hole and the second tab extends into the second through-hole and the first vane and the second vane do not crush the feather seal.

* * * * *